United States Patent [19]

Gaul et al.

[11] Patent Number: 4,649,674

[45] Date of Patent: Mar. 17, 1987

[54] DRAIN HOLE SEAL WITH BOTTOM BLEEDER

[75] Inventors: Craig S. Gaul, R.D. #2, Box 414, Birdsboro, Pa. 19508; Oliver M. Knutson, R.D. #8249, Sinking Spring, Pa. 19608; Donald C. Watson, Reading, Pa.

[73] Assignees: Craig S. Gaul, Birdsboro; Oliver M. Knutson, Sinking Spring, both of Pa.

[21] Appl. No.: 840,143

[22] Filed: Mar. 17, 1986

[51] Int. Cl.[4] ..... E02D 29/14

[52] U.S. Cl. ..... 52/20; 404/25; 210/165

[58] Field of Search ..... 52/19, 20, 21; 404/25, 404/26; 210/165; 49/465

[56] References Cited

U.S. PATENT DOCUMENTS

| | | | |
|---|---|---|---|
| 3,712,009 | 1/1973 | Campagna | 52/20 |
| 4,030,851 | 6/1977 | Graybeal | 404/25 |
| 4,067,659 | 1/1978 | Campagna, Jr. et al. | 404/25 |
| 4,305,679 | 12/1981 | Modi | 404/25 |
| 4,486,122 | 12/1984 | Arntyr et al. | 52/20 X |
| 4,512,492 | 4/1985 | Graybeal | 404/25 X |

*Primary Examiner*—Carl D. Friedman
*Attorney, Agent, or Firm*—D. C. Watson

[57] ABSTRACT

A device for a drain, such as a manhole 10 for access to a sewer, is protected by a seal structure 34 having a bottom bleeding feature such as a bottom thru-bore 42. The seal structure 34 may have a flange 38 for sealingly engaging between a cover 22 and a frame 18 around an accesshole 17 of the manhole 10. The structure 34 has a central portion downwardly depressed to avoid a path of spin of the cover 22. In a bottom portion 40 of structure 34, the thru-bore 42 bleeds (such as by thin trickling streams) into and off the sewer, sufficient fluids such as air to maintain a substantially atmospheric level of pressure in the sewer. Because of its size and shape, the thru-bore 42 advantageously bleeds into the sewer, from water introduced to manhole 10, only quantities of water known to be tolerated by the sewer system. To avoid unsanitary conditions, when water stops entering accesshole 17, the thru-bore 42 substantially completely drains away water remaining in the seal structure 34.

13 Claims, 6 Drawing Figures

DRAIN HOLE SEAL WITH BOTTOM BLEEDER

TECHNICAL FIELD

This invention relates to a drain hole seal having a bottom bleeder. More particularly, the invention relates to a structure for sealing, in an unpressured manner, an accesshole in an access device such as a manhole assembly leading to a subsurface drain such as a sanitary sewer.

BACKGROUND OF THE INVENTION

Subsurface drain systems are particularly vulnerable to infiltration into them of unwanted fluids. For example, a sanitary waste system comprises plumbing collection systems in buildings where waste is generated, an external sewer collection system and a treatment plant. The plumbing and sewer systems are typically designed to operate at half-full (or a lot less because of minimum pipe sizes). However, the treatment facility may be designed to operate at up to about ninety percent (90%) of its capacity and enlarging such capacity is difficult and very expensive to do. Moreover, operating costs increase with fluid quantities and treatment methods are similar whether the waste is raw or swelled with storm water which has infiltrated the plumbing and sewer systems. During heavy storms, some older treatment plants may get up to twice the amount of waste seen during more normal periods.

The collection systems experience infiltration for many reasons and from various sources. For example, the collection systems operate by gravity so access for air to or from such drains is provided through venting devices. Also, drain pipes in the systems are vulnerable to clogging by waste and debris so other access for inspection and cleaning is provided through devices such as lamphole, manhole and smaller, cleanout devices. Unfortunately, many venting and other access devices are installed at or below surfaces which carry runoff water during storm periods and such runoff gets into the drains. Moreover, the amount of such runoff is increasing to unexpected levels because of dense proliferation of buildings, shopping centers and substantially impervious paved surfaces. Surface-located, access devices often take on and pass to the subsurface drains too much water to be efficiently handled at a treatment plant so efforts are often made to seal such devices from unwanted fluids such as runoff water.

Prior art structures for sealing accessholes to subsurface drains were installed primarily in popular, cylindrical style, sewer manholes having circular frames and covers. Such covers could not be dropped through, but were often spinned in, the frames by manipulation during closing, so sealing structures were downwardly depressed to avoid collision and damage by such spinning of covers. Many features were included in an effort to close tightly against the frames and to completely seal all fluids from passing to and from the sewers. Such fluids primarily included errant storm water passing into a sanitary sewer but other fluids could not be ignored. For example, gas such as air is moved into and out of a sewer by short term vacuum and pressure conditions caused by flowing waste and temperature conditions. Also, garages and similar service buildings sometimes contribute gases which form in and must be relieved from a sewer to avoid explosions.

In some fully sealing, prior art structures, gases are bled into and off of a sewer by spring-loaded valves which require a measurable pressure differential over a respective valve between a drain and a surface to function. Such valves are costly to make, costly to repair or replace and a problem to keep operating because of dirt which tends to enter and cling to valve mechanisms. Two valves are typically installed in walls above the bottom of a structure to avoid dirt to handle vacuum and pressure separately, or so one may function when the other is inoperable. After a first storm, there is permanently trapped in such a seal, a sizable quantity of water wherein foul-smelling and disease propagating organisms may breed.

Accordingly, it is desirable to develop new and improved expedients for sealing a device having an accesshole to a subsurface drain. Such expedients should be simple in design, inexpensive to make and install and easy to maintain. Traditional teaching leads to fully sealed structures which require valves needing differential pressures thereover to operate and such seals are complex, costly and difficult to maintain. Such teaching needs reviewing to develop expedients which are simple and sanitary and which can readily be extended to housetrap vents and cleanout devices in plumbing systems as well as street manholes.

SUMMARY OF THE INVENTION

A device such as a manhole typically provides access from a region on and above a surface to a subsurface drain such as a sanitary sewer. According to the invention, there is provided at such manhole, a seal structure having a bottom feature for bleeding fluids in a trickling manner without imposing any significant pressure on the sewer. Such manhole typically has a frame around an accesshole through which at least some fluids may pass to and from the surface region and the sewer and the frame typically has inner surfaces to seat a cover. A cover has a body with outer surfaces to engage the seats of the frame and pick holes and sometimes vent holes through which fluids may pass to and from the surface region and the sewer when the cover is seated. When the cover is manipulated during closure of the manhole, the body often outlines a given spatial path extending below its seats on the frame. The seal structure preferably has outer flanges for location adjacent the cover for substantially sealingly engaging the frame. The structure also has a central portion which is sufficiently downwardly depressed to a bottom portion to provide the spatial path for the cover. In the bottom portion a preferred thru-bore is conveniently provided for bleeding into and off the sewer, fluids scuh as air and other gases to maintain a substantially atmospheric level of pressure in the sewer. The thru-bore is also adaped to bleed into the sewer, from fluids introduced to the manhole, only a quantity which is tolerable for operation of the sewer and a treatment plant to which such sewer may be connected. Advantageously, the thru-bore is located such that it substantially completely drains from the seal structure, fluids such as storm water remaining therein after a storm has ended and the water stops passing into the manhole.

BRIEF DESCRIPTION OF THE DRAWING

The invention will be more readily understood from the following detailed description when read in conjunction with the accompanying drawing wherein.

Figure 1:
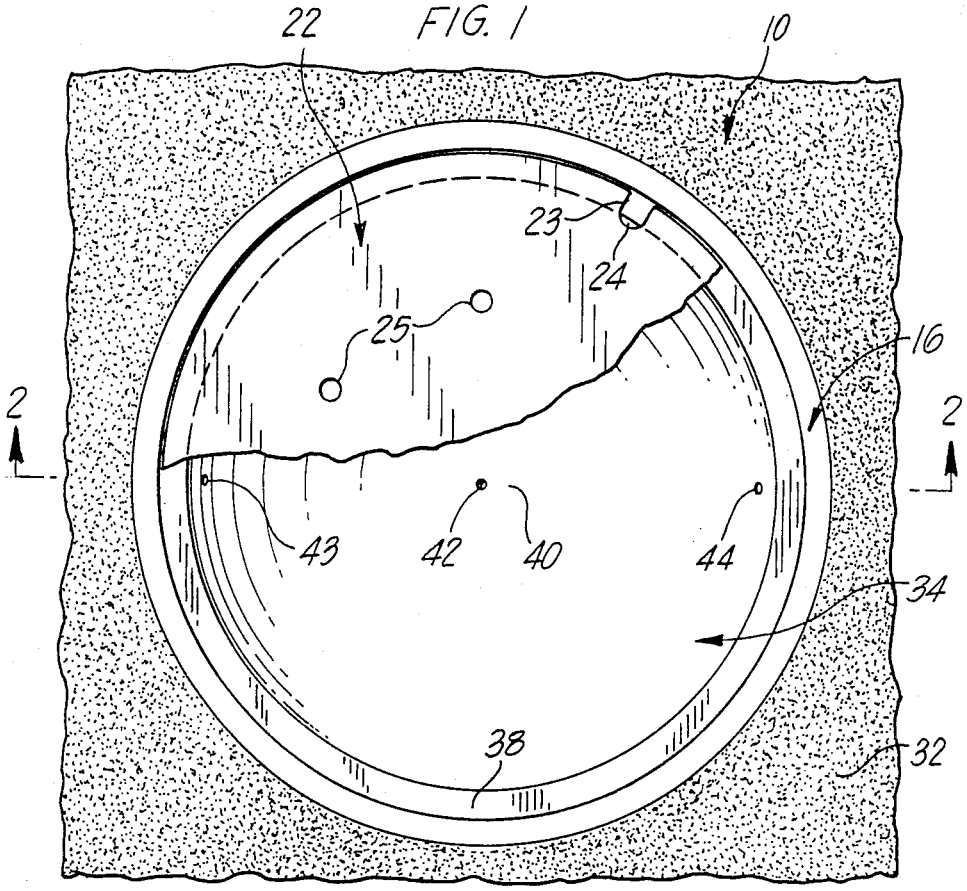
FIG. 1 is a plan view, partially cut away to show a conventional manhole equipped with a seal structure according to the instant invention.

Some elements in the figures are abbreviated or simplified to highlight certain features of the invention. Also, where appropriate, reference numerals have been repeated in the figures to designate the same or corresponding features in the drawing.

DETAILED DESCRIPTION

Drain Access Devices

Figure 2:
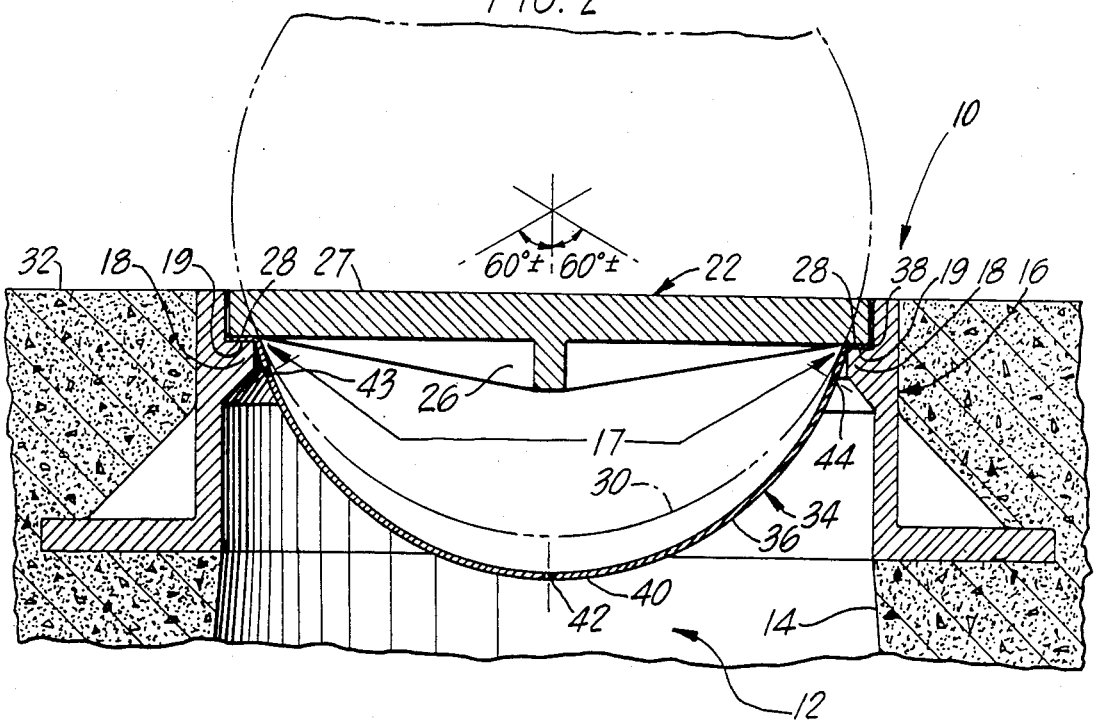
FIG. 2 is a cross-sectional view taken along line 2—2 of a top portion of the manhole and seal structure shown in FIG. 1.

By a drain, it is meant any subsurface conduit for liquid transportation operating at substantially atmospheric pressure, to include a sewer. FIGS. 1–4 will now be discussed to explain elements of the prior art depicted therein. FIG. 1 shows in plan view, a manhole assembly (also referred to herein as a device) designated generally by the numeral 10. FIG. 2 shows a sectional view of a top portion of manhole 10.

Manhole 10 is utilized to provide access for a service person to climb downward into a vertically oriented, nearly cylindrical underground chamber 12 through which one or more drains such as sewers are installed (not shown).

FIG. 2 shows vertical walls 14 which form the chamber 12 and also support a frame 16 having a cover 22 to limit access to manhole 10. Such access includes, but is not limited to, access by the service person and by air and access by water which is runoff from adjacent land onto a surface 32, typically surrounding top edges of the manhole 10. Air, water and other fluids may pass to or from a region on or about surface 32 and the manhole 10.

Manhole 10 has other prior art features of interest to the discussion. For example, to support street traffic, the cover 22 has heavy ribs 26 and it seats snugly in frame 16 making such cover difficult to remove. There is formed into cover 22 at least one slot 23 (FIG. 1) having a portion 24, open to the chamber 12. A pick (not shown) may readily be inserted into slot 23 to get under cover 22 and to pry it from the seats in frame 16. Also, the slot portion 24 may readily pass fluids such as air to and from chamber 12 for pressure and vacuum relief. Unfortunately, water which passes along surface 32 may also enter chamber 12. If it is felt that more air is required to relieve pressure in chamber 12, one or more passageways such as holes 25 may be provided through cover 22, but they also tend to pass surface water to chamber 12.

Figure 3:
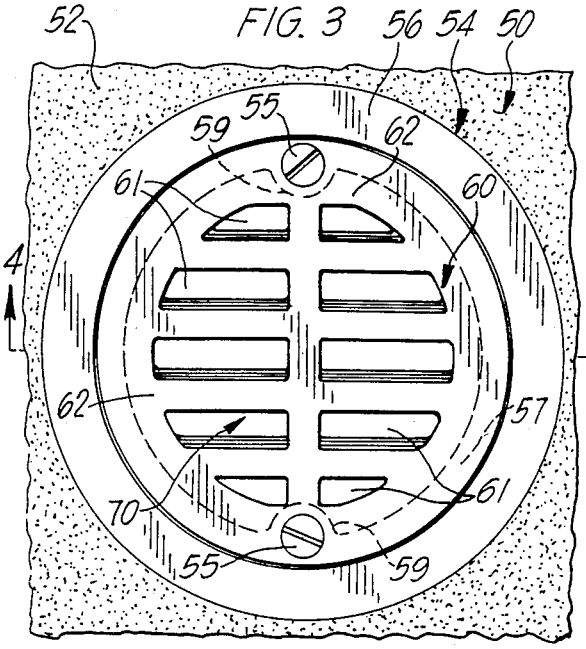
FIG. 3 is a plan view showing a conventional venting and cleanout plumbing device equipped with a seal structure according to the instant invention.

FIG. 3 is a plan view of a venting and cleanout plumbing device 50 for connection to building collection systems. Device 50 may be used where a vertical pipe 51 (FIG. 4) from a drain (not shown) is brought to a surface 52. However, device 50 is most often used in connection with a "housetrap" used to prevent sewer gases from entering a building system. A housetrap has two pipes brought to the surface, usually to a sidewalk near a street curb. A pipe (for cleanout only) on the sewer side of the trap is not shown. Pipe 51 rises from the building side of a housetrap and is utilized for cleanout and for venting air often pushed ahead by waste as it leaves the building. Device 50 has a frame 54 which supports a cover 60 having a plurality of vent openings 61. Frame 54 is supported by a collar section 68 (FIG. 4) being adjustable by threads 69 so the flat cover may register as shown with the sidewalk surface 52. Openings 61 pass air to and from pipe 51 to vent a drain collection system (not shown). Unfortunately, the openings 61 also tend to take on a lot of runoff water from surface 52 and pass such water to a collection system and waste treatment plant.

Prior Art Seals

In the prior art, probably the closest seal to this invention is limited to street manholes such as a cylindrical manhole 10 having a circular frame 16 as shown in FIGS. 1–2. Such prior art seal utilizes a continuous member which looks a lot like a member 36 shown in FIG. 2 but which has significant differences to be explained later. For example, member 36 typically has at least one unobstructed passageway according to the invention but member 36 will be assumed to be continuous for discussion of the prior art.

The subject matter of the invention is referred to generally as seals for accessholes to drains. When seals are referred to herein, they include applicants' seal structure 34 shown in FIGS. 1–2, of which member 36 is a major feature.

In the prior art, a member somewhat like member 36 was installed in a fully sealed, essentially airtight manner in an effort to prevent virtually any liquids from getting into a drain (typical specifications call for a maximum of one gallon per day passing to a drain utilizing some prior art seals). Unfortunately, about 10 gallons of liquids are typically trapped in such a bowl-shaped member after a first storm and remain there to cause foul smells and disease breeding organisms. When filled with liquids, such members are difficult to remove until the liquid is withdrawn. It will also be appreciated that subsequent entry of dirt-bearing liquid causes build-up of fine dirt which cannot move through such a member to a drain.

Because of the virtual airtightness of such a continuous member, costly valves are employed to introduce air to relieve vacuum conditions in a drain and to expel air or other gases to relieve pressure conditions. All such valves typically require a differential of pressure over them to operate. For example, about 0.5 psi may be required to expel air to relieve pressure and about 2.25 psi may be required to relieve vacuum. It will be appreciated that such positive or negative pressure in a sewer may cause other problems such as to intensify explosive conditions, to interfere with assemblies opening for access to a drain and to aggravate poor, pipe joint conditions. Yet such or similar valves are required if a seal is to be virtually airtight. The question arises whether total exclusion of runoff liquids from drains is justified by the problems, the extra cost and the complexity of airtight seals.

Infiltration Into Drains

Infiltration of liquids into drains can occur from above and below ground level. Generally, infiltration from above ground is due to storm water runoff but not all such water gets to or goes into open features such as street manholes. For example, it is known that from about 0.05 to about 0.7 of a quantity of surface water percolates into ground through macadam or grass surfaces, respectively, and may wet external portions of subsurface drains.

A typical unprotected manhole may pass to drain, from 3,000 GPD to 12,000 GPD of surface water (as reported by developers of prior art seals in their literature). But a 300 to 400 foot long wetted portion of pipe between manholes may pass into a collection system another 400 to 2,500 GPD due to subsurface infiltration (according to engineering textbooks, e.g., by Metcalf and Eddy). And building venting devices at sidewalk level may pass another 200 GPD eeach (equivalent to about 1,200 GPD per manhole) even if water only 0.06"deep appears on sidewalks (Applicants have verified such flows by testing). It seems desirable to seal off manhole water, but airtight sealing seems unjustified when viewed in light of the cost and problems with valves and the amount of infiltration to systems. Also, it clearly appears that such sealing should be amenable to sidewalk venting devices.

New Seal Structures

FIGS. 1–6 show drain access devices having seal structures as taught by the instant invention. FIGS. 1–2 show a seal structure 34 adapted to suit the popular, vertically cylindrical, street manhole 10 described previously. At manhole 10, the frame 16 has an accesshole 17 which is typically about 21 inches in diameter to suit a typical person's dimensions for entering the chamber 12 to work on a sewer (not shown). At least some fluids may pass through accesshole 17 to or from the region on or about surface 32 to the unseen sewer. On a circular ledge 18, the frame 16 has inner seating surfaces 19 to accomodate a cover such as cover 22, sometimes having reinforcing fins 26.

The generally designated cover 22 has a body portion 27 with outer surfaces 28 for engaging the surfaces 19 of frame 16 for controlling access to manhole 10. Cover 22 also has at least one pick hole 23 and sometimes there are one or more vent holes 25 passing completely through the body 27. When cover 22 is seated, fluids such as air, gases, water, etc., may pass through holes 23 and/or 25 to and from the surface region and the manhole drain. Cover 22 is not always readily manipulated onto and off of the ledges 18 or frame 16. Often a cover 22 is dropped onto and spins in frame 16 to outline a spatial path 30 shown in phantom lines in FIGS. 1–2. Therefore, it is desirable that a seal structure be shaped to avoid path 30.

The seal structure 34 of the present invention has outer means such as one or more flanges 38 for substantially sealingly engaging the access frame 16. Fortunately, flange 38 rests on surfaces 19 of ledge 18 and is compressed by adjacent surfaces 28 of the cover 22 to encourage such sealing. Note that member 36 of seal structure 34 has a central portion which is sufficiently downwardly depressed to a bottom portion 40 that the spatial path 30 of the cover 22 is avoided.

There are means in the bottom portion 40 for bleeding into and off the manhole drain, sufficient fluids to maintain a substantially atmospheric level of pressure in the manhole 10 and its drain. By bleeding, it is meant that liquids pass in a thin stream such as by trickling and gases pass in a thin stream at a low rate (volume per time unit). For example, the bottom bleeding means also bleeds into the drain (from any fluids introduced to the accesshole 17) only an amount tolerable to a collection and treatment system. It is believed a tolerable amount is an amount which is not large when compared with the hidden, underground infiltration such as the 400 to 2,500 GPD expected at a manhole from outside into a leaky bottom or from entry into pipes between each manhole. Applicants have found that a quantity of about 100 to 300 GPD from a seal structure into each of the manholes which experience runoff water during rain storms is readily tolerated in a collection and treatment system.

Such a bleeding means is advantageously provided in member 36 by a thru-bore 42 of a desired size and shape. For example, a member 36 may have walls which are about 0.125 inch thick and thru-bore 42 may be about 0.2 inch in diameter and have sharp edges. In an illustrative example, a storm may provide runoff to manhole 10 which averages 4.0 inch deep on surface 32 for a first hour, 1.0 inch deep for a second hour and 0.5 inch deep for a third hour. Such a storm is believed to occur only about once every 10 years. The illustrative thru-bore 42 is found by experiment to bleed about 100 GPD to a drain during such a storm. Moreover, after a storm stops and liquids stop passing into accesshole 17, the thru-bore 42 substantially completely drains the seal structure 34 of liquids remaining the member 36.

It will be appreciated that the 0.2 inch diameter thru-bore 42 was chosen for simplicity and example. A bleeding means could as well be any shape of passageway through member 36 providing it is substantially constantly unobstructed so fluids may pass to and from a drain in the desired manner.

Other Embodiments

In another embodiment, the seal structure 34 may have means in an upper portion of member 36 for bleeding fluids in the desired manner. Such means are particularly useful when heavy introduction of mud and similar matter is expected to plug holes such as the thru-bore 42 in bottom 40.

In an illustrative example, two thru-bores 43 and 44, each having a diameter of about 0.2 inch and sharply cut edges, were provided in member 36 as shown in FIG. 2. In the illustrative storm described above, thru-bores 43 and 44 are calculated to bleed into chamber 12, about 100 GPD each, over and above the 100 GPD passed by bottom thru-bore 42.

It will further be appreciated that bowl-shaped member 36 may not always be completely full in a certain storm. For example, other thru-bores may be so sized and so arranged in combination with bottom bore 42 that fluids are bled into chamber 12 in amounts proportional to the amounts introduced to accesshole 17.

In another embodiment, seal structure 34 may be of substantially unitary construction. For example, the walls of member 36 and the flanges 38 may be of an elastomer sheet such as polyvinylchloride or polyethylene sheet which is heat formable. By using a top and bottom form, the sheet is deep formed, trimmed and then bored to obtain a seal structure 34 having a substantially uniform thickness.

Figure 4:
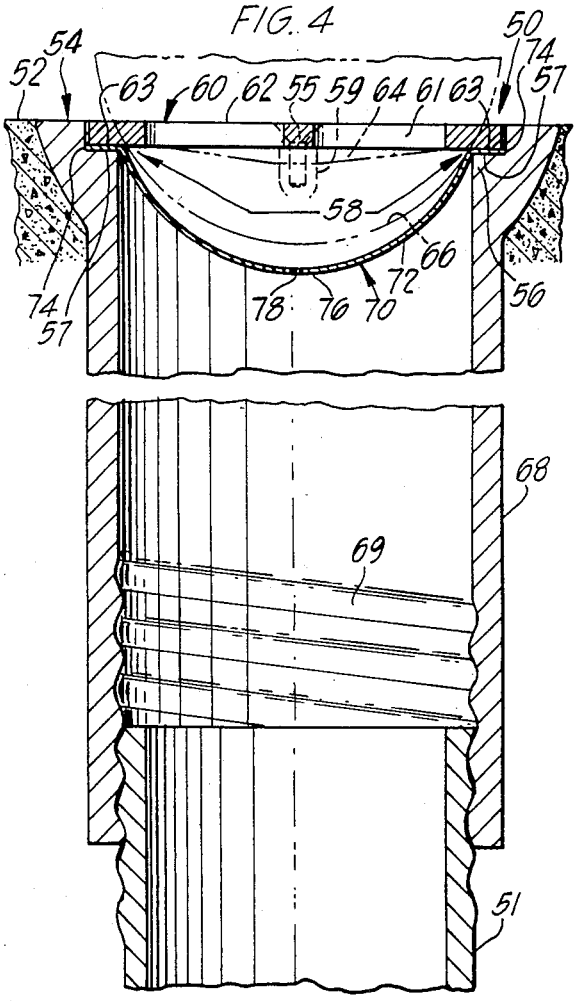
FIG. 4 is a cross-sectional view taken along line 4—4 of a top portion of the plumbing device and seal structure shown in FIG. 3.

Referring now to FIGS. 3–4, the cleanout and venting device 50 is shown which was described previously and which was noted to contribute considerable quantities of water to collection systems. Where buildings are densely located, concrete sidewalks are generally found and the runoff of water into each device 50 is high. But even in suburban areas, several buildings are connected between each manhole and even grass surfaces contribute water because an effort is made to adjust a device 50 at or below adjacent ground levels for ease of mowing grass. Unfortunately, the openings 58 in a cover 56 are extensive, sometimes even more extensive than manhole covers, so such devices are a problem where infiltration of unwanted liquids is to be minimized.

Frame 54 has on flanges 56, surfaces 57 which extend inside the peripheral edges of the cover 60 to accomodate such cover. Note, however, that threaded screws 55 are provided to hold the cover 60 in place so the flanges are made wider in the form of bosses 59 at two places to accomodate such screws.

Usually a cover 60 has a body 62 in the form of a thin disc of strong metal having outer surfaces 63 for engaging the surfaces 57 of the flanges 56. In heavy duty areas, a cover 60 may have reinforcing fins 64 shown in phantom lines. When cover 60 is manipulated for closing, it may fall into and spin in frame 54 creating a spatial path 66 which should be clear of features which may be damaged. The openings 61 in cover 60 may pass fluids into and out of the drain pipe 51 through an accesshole 58 defined by the inside edges of flanges 56.

A seal structure 70 of the present invention may be advantageously utilized to limit passing of fluids to and from drain 51 without problems with pressure and vacuum venting valves. Structure 70 has a member 72 which is supported by outwardly extending flanges 74 for sealingly engaging between the cover 60 and the frame flange 56. Structure 70 has a central portion which is downwardly depressed to a bottom portion 76 to avoid the spatial path 66 of cover 60. Conveniently, structure 70 has bleeder means such as a thru-bore 78 for bleeding into and off the drain pipe 51, sufficient fluids to maintain a substantially atmospheric level of pressure in the drain. During wet periods, thru-bore 78 bleeds into drain pipe 51 only a quantity of fluids which may be tolerated in a concommitant collection system. Also, when fluids stop passing into accesshole 58, the thru-bore 78 substantially completely drains fluids remaining in member 72.

Figure 5:
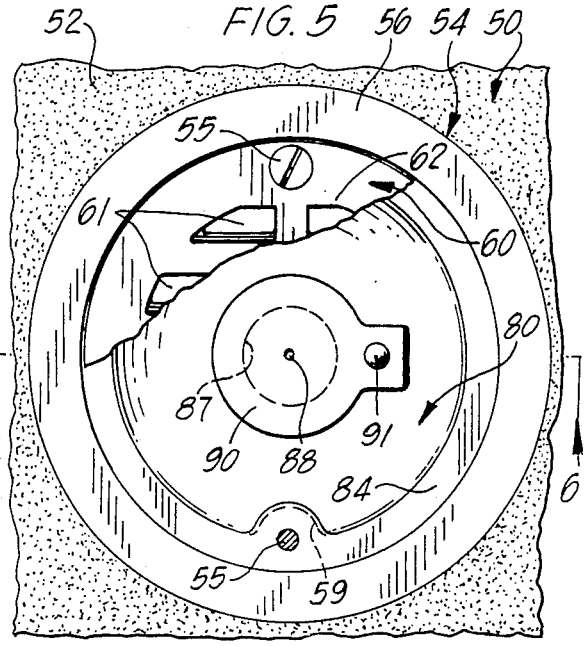
FIG. 5 is a plan view, partially cut away to show the conventional venting and cleanout plumbing device shown in FIG. 3 and equipped with another embodiment of a seal structure according to the instant invention.
Figure 6:
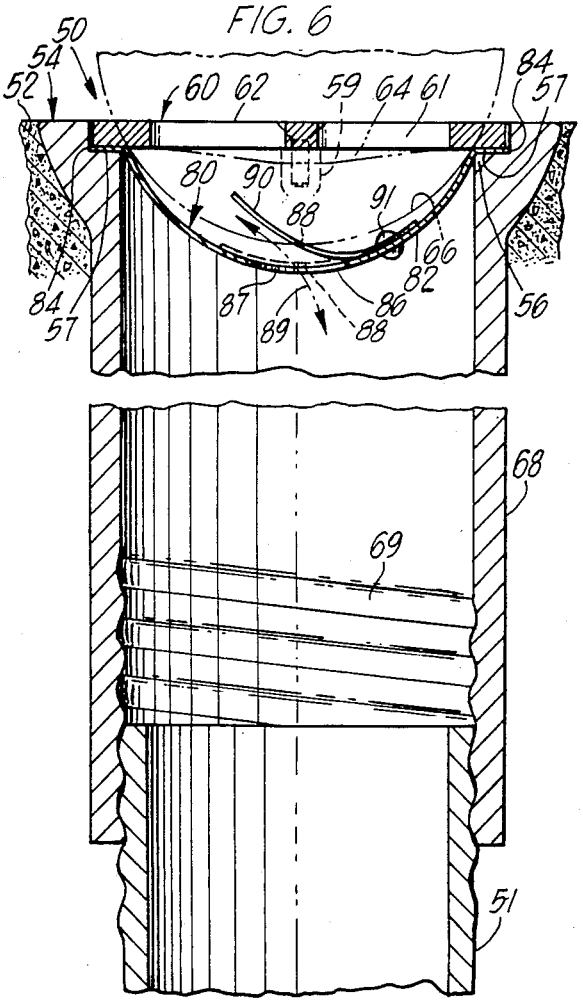
FIG. 6 is a cross-sectional view taken along line 6—6 of a top portion of the plumbing device and seal structure shown in FIG. 5.

FIGS. 5–6 show another device 50 having similar features to that shown in FIGS. 3 and 4 so all such features carry the same numerical designation. However, FIGS. 5–6 show a different seal structure for sealing a drain pipe 51.

Some plumbing codes are specific about the amount of venting air or gas which should be accomodated in drains, particularly at housetraps. The waste fluids are meant to be detained in housetraps to prevent sewer gases from getting into occupied buildings. And surges of waste leaving buildings at a fast pace could compress air in a pipe sufficient to force out the contents of a housetrap. A seal structure 80, according to this invention, is provided to satisfy such a plumbing code and to accomodate surges of air in a drain.

A structure 80 has a member 82, flanges 84 and a bottom 86 which are respectively similar in form and function to items 72, 74 and 76 described and discussed for structure 70 in FIGS. 3–4. However, there is provided in bottom 86, a venting hole 87 of a size to suit an applicable plumbing code, e.g., about 1.2 to 1.5 inches diameter, to pass compressed air as shown by arrow 89. Unfortunately, a hole such as vent hole 87 does not permit bleeding of fluids as taught by the invention.

To effect such bleeding, hole 87 is protected by a flapper 90 made of a flexible material such as rubber, or some other elastomer which has lubricative surfaces. Flapper 90 is attached to member 82 such as by a rivet 91. When large volumes of air in pipe 51 are compressed, flapper 91 may be raised and venting may occur according to the arrow 89. During most conditions, flapper 90 lays over hole 87 (as shown by phantom lines) and drain pipe 51 is sealed from entry of fluids. However, it is desirable to drain bowl-shaped member 82 to avoid trapping fluids to breed foul smells and organisms.

A thru-bore 88 is advantageously provided in flapper 91 to perform normal functions according to the invention. For example, normally bore 88 bleeds into and off of drain pipe 51, sufficient fluids to maintain a substantially atmospheric level of pressure in pipe 51. Also, bore 88 bleeds into pipe 51 only a tolerable quantity of liquids introduced into accesshole 58 during runoff periods. And advantageously, the bore 88 drains structure 90 in a substantially complete manner of all fluids remaining therein after fluids stop passing through accesshole 58.

Other Considerations

Most literature dealing with seal devices recite testing for a runoff condition which provides about a 1.0 inch depth of water over a manhole. Although rainfall data is available for periods of up to 100 years, it is very difficult to predict what runoff conditions will occur for any particular manhole. Using the 1.0 inch depth condition cited in most literature, applicants have found that a 0.1 inch diameter bleeder such as thru-bore 42 (FIG. 1) will pass less than 0.5 gallon per minute of water to a drain. Even if such conditions obtain for 3 hours in a day, the infiltration is only about 90 GPD from a manhole 10 having a seal structure 34.

It will also be appreciated that a seal structure 34 is readily cleaned of debris which may enter a manhole 10. Substantially, no water need be removed and member 36 has a smooth top surface, uninterrupted by features such as valves which impair cleaning.

There have been illustrated herein certain practical embodiments and applications of the invention. It is believed that one of ordinary skill in this art can, with little experimentation, adapt the teachings so other devices may have seals with bottom bleeders. Such adaptations and refinements may be made without departing from the spirit and scope of the present invention.

What is claimed is:

1. A seal structure at means for access from a region on and above a surface to a subsurface drain, said seal structure having bottom bleeding means, comprising:

said access means having a frame around an accesshole through which at least some fluids may pass to and from the surface region and the drain, said frame having inner seating surfaces to accomodate a cover;

to control access to the drain, a cover having a body with outer means for engaging said inner seating surfaces of the frame and having at least one passage through the body such that when the cover is seated, said fluids may at least partially pass to and from the surface region and the drain, the body of such cover often outlining a spatial path extending below its seating surfaces by manipulation of the cover during closure of the accesshole;

a seal structure having outer means located adjacent the cover for substantially sealingly engaging the access frame, said structure having a central portion sufficiently downwardly depressed to a bottom portion to avoid the spatial path for the cover; and means in the bottom portion for bleeding into and off the drain, sufficient fluids to maintain a substantially atmospheric level of pressure in the drain, for bleeding into the drain only a tolerable quantity of any fluids introduced to the accesshole and for substantially completely draining from the seal structure, fluids remaining therein after fluids stop passing into the accesshole.

2. A seal structure as in claim 1, further comprising:

in the seal structure above the bottom portion, upper means for bleeding to and from the drain a desired amount of fluids in addition to that passed by the bottom bleeding means.

3. A seal structure as in claim 2, wherein the upper and bottom means for bleeding, further comprise:

each of said means being so sized and arranged in combination that the fluids are bled into the drain in amounts proportional to the amounts introduced to the accesshole.

4. A seal structure as in claim 1, wherein the bottom bleeding means comprises:

through the bottom portion and adapted for bleeding, and for draining fluids in the desired manner, at least one thrubore of a desired size and shape, forming a substantially constantly unobstructed passageway for the fluids.

5. A seal structure as in claim 1, wherein:

the drain is of the size and nature of a subsurface sewer system;

the access means is of the size and nature of a manhole device with frame and cover;

said frame having inner seating surfaces on an inwardly extending flange to accomodate the cover; and the outer sealing means of the seal structure being an outwardly extending flange for sealingly engaging between the cover and the frame flange.

6. A seal structure as in claim 5, wherein the bottom bleeding means further comprises:

a singular thru-bore being sized at about 0.2 inch diameter and of a shape adapted for bleeding less than about 0.5 gallon per minute of water into the drain when water about 1.0 inch deep on the surface is introduced to the manhole.

7. A seal structure as in claim 1, of unitary construction made by deep forming said structure from a sheet of material having substantially uniform thickness.

8. A seal structure as in claim 7 made with a smooth top surface uninterrupted by features which impair cleaning.

9. A seal structure as in claim 1, wherein:

the drain is of the size and nature of a subsurface plumbing drain;

the access means is of the size and nature of a cleanout and venting pipe extending to a surface fitting with frame and cover;

said frame having surfaces on flange means inside perpheral edges of the cover to accomodate the cover; and the outer sealing means of the seal structure being an outwardly extending flange for sealingly engaging between the cover and the frame flange.

10. A seal structure as in claim 1, wherein the bottom bleeding means is sized and adapted to relieve pressure and vacuum in the drain at substantially less than 0.5 psi pressure differential between the surface region and the drain.

11. A seal structure as in claim 1, wherein the downwardly depressed central portion is substantially shaped like a bowl.

12. In a manhole for access from a region on and above a surface to a subsurface sewer, of the type wherein a frame surrounds an accesshole through which at least some fluids may pass to and from the surface region and the sewer, there being inner seating surfaces to accomodate a cover having a body with outer means for engaging said inner seating surfaces of the frame and having at least one passage through the body such that when the cover is seated, said fluids may at least partially pass to and from the surface region and the sewer, the body of such cover sometimes outlining a spatial path extending below its seating surfaces by manipulation of the cover during closure of the manhole, said accesshole being protected by a seal structure having outer means located adjacent the cover for substantially sealingly engaging the access frame and having a central portion sufficiently downwardly depressed to a bottom portion to avoid the spatial path for the cover, the improvement comprising:

a thru-bore in the bottom portion for bleeding into and off the sewer, sufficient fluids to maintain a substantially atmospheric level of pressure in the sewer, and for bleeding into the sewer only a tolerable quantity of any fluids introduced to the accesshole and for substantially completely draining from the seal structure, fluids remaining therein after fluids stop passing into the accesshole.

13. A seal structure as in claim 1, wherein the bottom portion of the seal structure further comprises:

through the bottom of the seal structure, a venting hole of a size and shape to pass at a desired rate of flow, compressed fluid from the subsurface drain, such hole being larger than desired for bleeding and for draining fluids in the desired manner;

a flapper for closing over the vent hole and flexibly engaging the seal structure for sealing the venting hole from fluids passing into the subsurface drain; and in the flapper and over the vent hole, at least one substantially constantly unobstructed thru-bore of a size and shape for bleeding and for draining the fluids in the desired manner.

* * * * *